United States Patent [19]

Carini

[11] 4,190,444

[45] Feb. 26, 1980

[54] CONTINUOUS CASTING MOLD FLUX POWERS

[75] Inventor: George F. Carini, Penn Hills, Pa.

[73] Assignee: The Clay Harden Company, Pittsburgh, Pa.

[21] Appl. No.: 874,024

[22] Filed: Feb. 1, 1978

[51] Int. Cl.[2] ..... C22B 9/10; B22D 11/00

[52] U.S. Cl. ..... 75/257; 75/53; 164/4; 164/73; 164/82

[58] Field of Search ..... 75/257, 129, 53–58; 164/82, 4, 73

[56] References Cited

U.S. PATENT DOCUMENTS 3,320,052 5/1967 Bowden ..... 75/53

3,704,744 12/1972 Halley ..... 75/257

*Primary Examiner*—Peter D. Rosenberg

*Attorney, Agent, or Firm*—Webb, Burden, Robinson & Webb

[57] ABSTRACT

This invention relates to mold flux powders for the continuous casting of steel. The mold flux powders comprise a plurality of sequential melting systems forming successive melts and in turn taking the ingredients of the next system into solution. In this way, the desired fluidity is achieved in the mold flux at a rate required by the particular continuous casting process in which the flux is being used without resorting to an excessively low melting flux. At least one of the systems comprises a finely-divided glass.

7 Claims, No Drawings

CONTINUOUS CASTING MOLD FLUX POWERS

BACKGROUND

The importance of providing proper flux over the molten metal surface in a continuous casting mold is apparent from the numerous patents which have issued relating to the subject. See U.S. Pat. Nos. 3,970,135; 3,964,916; 3,949,803; 3,937,269; 3,926,246; 3,899,324; 3,891,023; 3,788,840; 3,718,173; 3,708,314; 3,704,744; 3,685,986; 3,677,325; 3,649,249; 3,642,052, 3,607,234; 3,318,363; 3,052,936; 2,825,947.

Much of the prior art focuses on softening point and fluidity of the melted fluxes. Little consideration has been given to rates; that is, the rate at which the mold flux powder melts sufficiently to spread and the rate at which the mold flux powder achieves its final desired fluidity so that it can be carried out of the mold in the space between the billet, bloom or slab being cast and the mold walls. If a mold flux remains over the surface of the metal in the mold too long, it either picks up too much of the deoxidation product it is designed to scavenge, and therefore loses fluidity, or it becomes so loaded with these products that it cannot pick up additional deoxidation products which it is supposed to remove. Certain prior art fluxes have actually "iced over" in the mold, due to low tolerance to deoxidation products, e.g., alumina. Some consideration has been given to the rates at which the deoxidation products are taken into the molten flux, but the reasoning has been superficial. The important consideration is the rate of removal of the deoxidation products from the mold. This rate is controlled not only by the rate at which the deoxidation products are taken into the melt, but also the fluidity tolerance of the melt to dissolved deoxidation products and the rate at which the loaded flux is removed from the mold. Either rate can be controlling and, of course, they are usually interrelated.

Because numerous types and grades of steels are being continuously cast, i.e., stainless steel, high-carbon steel, low-carbon steel, aluminum-killed steel, etc., all at different temperatures and different casting rates the continuous caster must have available a range of flux compositions which will have a softening point and fluidity compatible with the particular product and casting rate. If a mold flux is too fluid or becomes fluid too fast, it will be carried away from the mold at a higher rate than desirable. The drawback to the too rapid removal of mold flux from the mold is the need for larger amounts of mold flux powder to be spread over the mold during casting. This, of course, is a most important economic consideration.

In the past, casting fluxes having lower melt point temperatures and greater fluidity than necessary have sometimes been adopted simply because this was the only means of achieving sufficiently rapid melting, spread, and solubility for deoxidation products. Applicant provides a mold flux which has a controlled rate of fusion, rapid spread, intermediate fluidity, and high tolerance to dissolved deoxidation products which does not adopt low melt and/or softening point temperatures simply to provide the desired rate of melting, spread, and removal of deoxidation products.

SUMMARY OF THE INVENTION

This invention relates to a mold flux powder useful for continuous casting of numerous steel grades and which has been found to provide exceptional casting surfaces in various steels including, for example, aluminum-killed steels which are known to be particularly difficult to cast. The following table sets forth the ranges of the preferred compositions. Within these ranges, as explained herein in detail, the composition can be varied to provide the desired softening point and fluidity.

TABLE I

| Batch Ingredient | Weight Percentage |
|---|---|
| Flyash and Whiting | 60 to 80 |
| Cryolite or Cryolite and Fluorspar (mixture up to 50/50) | 10–20 |
| Glass or Glass Mixture (softening points 1200° to 2000° F.) | 10–20 |
| Sodium Nitrate | up to 1 |

The preferred range of ratios of flyash to whiting is from 0.65 to 0.75 by weight. Workable flyash to whiting ratios exist between 0.5 and 2.0. Fluidity will increase if flyash content is increased while holding other batch components constant. Whiting is natural or synthetic calcium carbonate. Partial substitution of barium carbonate for whiting is permissable and may even be desirable in certain applications.

The preferred glass composition comprises, in weight percent, $Na_2O$—8 to 18; $K_2O$ up to 8; $B_2O_3$—15 to 25; $SiO_2$—20 to 35; $F_2$—4 to 8; CaO—10 to 15, and BaO—10 to 15. The softening point temperature of the glass or mixtures of glass should preferably be between 1300 and 1850° F. Workable glass compositions, comprise, in weight percent, $Na_2O$—8 to 25; $K_2O$—0 to 8; $B_2O_3$—0 to 25; $SiO_2$—20 to 75; $F_2$—0 to 12; CaO—10 to 30; MgO—0 to 3; BaO—0 to 15; and $Al_2O_3$—0 to 3.

The compositions set forth in the above table are comprised of at least three and sometimes four fluxing systems which sequentially melt and act to flux (promote melting) of the next system. In actual use, the sodium nitrate melts almost immediately and serves to provide a certain tackiness to the remaining ingredients to prevent dusting in the mold.

The next system of ingredients to melt is the glass. The melting point and amount of glass (or mixture of glasses) may be selected to provide the desired rate of melting. The glass here is perhaps the most significant ingredient for achieving the desired melting rate for the overall flux powder system.

After and to some extent during the melting of the glass, the fluorspar and cryolite which are present in a low melting relationship react and melt. Finally, the melt comprising the ingredients of the glass, fluorspar and cryolite take the whiting-flyash system into solution. The lime is added to the overall composition so that the lime-silica ratio of the melted flux promotes with sodium and fluorine the solution of deoxidation products, for example, alumina where the steel being cast is aluminum-killed steel. The final flux composition depends upon a number of factors, for example, the residence time of the flux over the metal and the particular type of metal being cast. Hence, the final melted flux composition is determined not only by the composition of the mold flux powder but by the presence of deoxidation products which the mold flux is designed to dissolved and to remove.

DESCRIPTION OF THE PREFERRED EMBODIMENTS

Mold flux powders having the following batch compositions, were prepared and tested for softening point as indicated. In these examples, Glass A, Glass B and Glass C have softening point temperatures of 1300°, 1400° and 1800° F. respectively.

TABLE II

| Example | I | II | III | IV | V |
|---|---|---|---|---|---|
| Flyash | 25% | 25% | 25% | 25% | 25% |
| Glass A (1300° F.) | 20 | 10 | | | |
| Glass B (1400° F.) | | 10 | 20 | 10 | |
| Glass C (1800° F.) | | | | 10 | 20 |
| Fluorspar | 10 | 10 | 10 | 10 | 10 |
| Cryolite | 10 | 10 | 10 | 10 | 10 |
| Whiting | 34 | 34 | 34 | 34 | 34 |
| Sodium Nitrate | 1 | 1 | 1 | 1 | 1 |
| Softening Point | 1835° F. | 1855° F. | 1875° F. | 1925° F. | 1975° F. |

The percentages set forth in the table are by weight. The softening points set forth in the table were obtained by the following procedure: A pellet of the batch ingredients was compacted and placed on a cordierite plate. The pellets had a cylindrical shape as pressed. The pellet on the plate is inserted in a furnace at a test temperature and after five minutes observed. If the shape of the pellet is hemispherical but has not flowed on the plate, then that temperature is designated the softening point temperature. There are, of course, more sophisticated techniques for measuring softening points but this one is adequate. As with all techniques, the softening point is only an indication of the temperature at which melting first begins.

The mold fluxes of Examples I, II, and III above were used in the production of continuous casting of aluminum-killed steel and due to the excellent matching of the rate of achieving the desired fluidity and rate of casting, the surfaces of the continuously cast billets and slabs were outstanding compared to all prior tested mold flux powders. The mold flux designated Example III has been used for casting high and low carbon steels in billets, bloom and slabs. The mold flux powder designated Example V above has been used in continuous casting manganese-silicon-killed steel and perform particularly well in that application.

The overall chemical analyses of the mold flux powders of Examples I, III and V are set forth in the following table. The percentages are by weight.

TABLE III

| Example | I | III | V |
|---|---|---|---|
| $SiO_2$ | 16.6% | 18% | 23.6% |
| $Al_2O_3$ | 7.5 | 7.5 | 7.8 |
| $Fe_2O_3$ | 3.4 | 3.4 | 3.5 |
| $F_2$ | 9.5 | 9.5 | 8.5 |
| $B_2O_3$ | 4.0 | 4.0 | — |
| CaO + MgO | 29.7 | 29.7 | 30.1 |
| BaO | 3.1 | 3.1 | — |
| $Na_2O$ | 7.2 | 5.9 | 6.9 |
| $K_2O$ | 1.5 | 1.5 | 0.4 |
| $SO_3$ | 0.4 | 0.3 | — |
| LOI | 17.2 | 16.9 | 17.0 |
| Total Carbon | 4.8 | 4.8 | 4.1 |
| Fixed Carbon | 0.7 | 0.7 | 0.6 |

L.O.I. stands for "loss on ignition." Note that the LOI exceeds 15 percent in Examples I, III and V demonstrating no need for precalcining the batch. In fact, it is believed that the removal of volatiles from the flux powder during the fluxing process provides a beneficial churning action.

The chemical analyses of Glasses A, B and C are given in the following table, along with the chemical analysis of a flyash which has been found suitable for the practice of this invention. The percentages are by weight.

TABLE IV

| | Glass A | Glass B | Glass C | Flyash |
|---|---|---|---|---|
| $Na_2O$ | 15.5% | 9.0% | 13.83% | .98% |
| $K_2O$ | 5.61 | 5.55 | 0.57 | 1.75 |
| $B_2O_3$ | 20.45 | 20.23 | | |
| $SiO_2$ | 25.60 | 32.74 | 72.15 | 47.1 |
| $F_2$ | 5.52 | 5.47 | | |
| CaO | 13.21 | 13.06 | 10.20 | 6.43 |
| MgO | | | 0.91 | 1.17 |
| BaO | 14.11 | 13.96 | 0.12 | |
| $Al_2O_3$ | | | 2.12 | 22.9 |
| $Fe_2O_3$ | | | 0.11 | 13.94 |
| $SO_3$ | | | | 0.2 |
| LOI | | | | 5.5 |
| Fixed Carbon | | | | 2.5 |

The glasses and flyash analyses set forth in Table IV are intended to be exemplary only. Other glass compositions and flyashes of similar composition would be expected to work well. The fixed carbon content of the flyash must be minimized where low carbon steels are being cast.

Additional higher temperture melting mold flux powders were prepared and tested for softening points as indicated in the following table. The percentages are by weight.

TABLE V

| Example | VI | VII | VIII |
|---|---|---|---|
| Flyash | 28.3% | 30.5% | 32.2% |
| Glass C | 16.2 | 13.5 | 11.7 |
| Fluorspar | 8.1 | 6.8 | 5.8 |
| Cryolite | 8.1 | 6.8 | 5.8 |
| Whiting | 38.5 | 41.6 | 43.8 |
| Sodium Nitrate | .8 | .7 | .6 |
| Softening Point | 2000° F. | 2045° F. | 2080° F. |

The overall chemical analyses of the mold flux powders of Examples VI, VII and VIII are set forth in the following table. The percentages are by weight.

TABLE VI

| Example | VI | VII | VIII |
|---|---|---|---|
| $SiO_2$ | 24.8% | 24.1% | 23.5% |
| $Al_2O_3$ | 8.2 | 8.4 | 8.6 |
| $Fe_2O_3$ | 3.9 | 4.2 | 4.4 |
| $F_2$ | 6.9 | 5.8 | 5.1 |
| CaO + MgO | 31.1 | 31.9 | 32.3 |
| $Na_2O$ | 5.7 | 4.8 | 4.3 |
| $K_2O$ | .5 | .5 | .6 |
| LOI | 18.9 | 20.4 | 21.3 |
| Total Carbon | 4.2 | 4.3 | 4.4 |
| Fixed Carbon | .7 | .8 | .9 |

An especially useful low melting mold flux powder was prepared and tested as shown in the following table.

TABLE VII

| Example | IX |
|---|---|
| Flyash | 25* |
| Glass A | 20 |
| Cryolite | 10 |
| Fluorspar | 10 |
| Whiting | 34 |
| Sodium Nitrate | 1 |
| Powdered Borax | 2.5 |
| Flake Graphite | 5.0 |
| Softening Point Temperature | 1800° F. |

*parts by weight-107.5 parts total.

The batch ingredients of the above described mold fluxes are finely divided, say minus 60 mesh U.S. Standard and preferably minus 100 mesh.

The mold fluxes described above can be modified by the addition of boron yielding compounds and/or soda yielding compounds such as powdered borax, anhydrous borax, boric acid, anhydrous boric acid, sodium nitrate, soda ash, sodium fluoride, etc. to increase fluidity and to lower the fusion temperature. As shown with Example IX, flake graphite may also be added to the mold flux powder where it is desired to have a reducing atmosphere in and about the mold flux.

Within the framework of the basic compositional range set forth in Table I, mold flux powders having softening point temperatures between about 1800° F. and 2080° F. have been demonstrated. The softening point temperatures can be shifted up or down in the range 1700° to 2200° F. by changing the blend of glasses as shown with reference to Table II, increasing or decreasing the amount of glass as shown with reference to Table V or by the addition of ingredients such as borax as shown with reference to Table VII.

Having thus described my invention with the detail and particularity required by the Patent Laws, what is desired protected by Letters Patent is set forth in the following claims.

I claim:

1. In the continuous casting of steel wherein the steel is teemed from a tundish to a continuous casting mold, the improvement comprising introducing to said mold during teeming, a mold flux powder, consisting essentially of, in weight percent, at least three sequentially melting systems, the first system comprising 10 to 20 percent of one or more glasses having softening point temperatures between 1200° and 2000° F., the second system comprising 10 to 20 percent cryolite, optionally mixed with fluorspar in a ratio up to 1, and the third system comprising 60 to 80 percent of a mixture of flyash and whiting, the weight ratio of flyash to whiting in the mold flux powder being in the range 0.5 to 2, whereby the fusion point, rate of fusion and fluidity can be tailored to the particular continuous casting process involved.

2. A composition of matter useful as a flux consisting essentially of, by weight, 60 to 80 percent of a mixture of flyash and whiting in a weight ratio between 0.5 and 2, 10 to 20 percent of a mixture of cryolite and fluorspar in a weight ratio up to 1, 10 to 20 percent of one or more glasses analyzing, by weight percent, $Na_2O$—8 to 25; $K_2O$—0 to 8; $B_2O_3$—0 to 25; $SiO_2$—20 to 75; $F_2$—0 to 12; CaO—10 to 30; MgO—0 to 3; BaO—0 to 15; and $Al_2O_3$—0 to 3.

3. The process of claim 1, wherein the weight ratio of cryolite to fluorspar in the mold flux is about 1.

4. The process of claim 3 wherein the glass or glasses in the mold flux have a softening point between 1300° and 1850° F.

5. The process according to claims 1, 3 or 4 wherein the weight ratio of flyash to whiting in the mold flux powder is in a range 0.65 to 0.75.

6. The process according to claims 1, 2, 3 or 4 wherein the glass or glasses in the mold flux powder analyzed, by weight percent, $Na_2O$—8 to 18; $K_2O$ up to 8; $B_2O$—15 to 25; $SiO_2$—20 to 35; $F_2$—4 to 8; CaO—10 to 15, and BaO—10 to 15.

7. The process according to claims 1, 2, 3 or 4 wherein the glass or glasses in the mold flux powder analyzed, by weight percent, $Na_2O$—8 to 25; $K_2O$—0 to 8; $B_2O_3$—0 to 25; $SiO_2$—20 to 75; $F_2$—0 to 12; CaO—10 to 30; MgO—0 to 3; BaO—0 to 15; and $Al_2O_3$—0 to 3.

* * * * *